US006206469B1

(12) United States Patent
Caruso et al.

(10) Patent No.: US 6,206,469 B1
(45) Date of Patent: Mar. 27, 2001

(54) STACKABLE SIDE-BY-SIDE GANGING CHAIR

(75) Inventors: Jerome C. Caruso, Lake Forest; Steven J. Caruso, Antioch, both of IL (US)

(73) Assignee: Shelby Willliams Industries, Inc., Morristown, TN (US)

( * ) Notice: Subject to any disclaimer, the term of this patent is extended or adjusted under 35 U.S.C. 154(b) by 0 days.

(21) Appl. No.: 09/354,956

(22) Filed: Jul. 16, 1999

Related U.S. Application Data

(63) Continuation-in-part of application No. 29/090,819, filed on Jul. 16, 1998.

(51) Int. Cl.[7] ..... A47C 15/00
(52) U.S. Cl. ..... 297/248; 297/239
(58) Field of Search ..... 297/248, 232, 297/239

(56) References Cited

U.S. PATENT DOCUMENTS

| | | | | |
|---|---|---|---|---|
| D. 279,438 | | 7/1985 | Gerner . | |
| 3,018,131 | * | 1/1962 | Krueger | 297/248 |
| 3,111,344 | * | 11/1963 | Hoven et al. | 297/248 X |
| 3,123,399 | * | 3/1964 | Wilson | 297/248 |
| 3,328,075 | * | 6/1967 | Albinson | 297/248 |
| 3,758,155 | * | 9/1973 | Straits | 297/248 |
| 3,827,749 | | 8/1974 | Johnson et al. . | |
| 4,400,031 | * | 8/1983 | DeDecker | 297/248 |
| 5,282,669 | * | 2/1994 | Barile | 297/248 X |

* cited by examiner

*Primary Examiner*—Anthony D. Barfield
(74) *Attorney, Agent, or Firm*—Pitts & Brittian

(57) ABSTRACT

A stackable chair that is capable of being ganged with a further like chair in side-by-side relationship, including an upper frame adapted to receive and support a seating platform, and a backrest platform for supporting a user seated on the chair. The upper frame is attached to a lower frame having a left and right sides, each said having a pair of leg members connected underneath the lower frame, each of the leg members having a lower end to engage the supporting surface for the chair, and having an upper end. The right legs connect to a right frame member attached to the lower frame right side. The left legs connect to a left frame member attached to the lower frame left side. A left side and a right side coupling support extend respectively on top of left and right frame members. The left side coupling support includes a left extension having a coupling hook extending outward. The right side coupling support includes a right extension having a lower surface enclosing a downward opening slot aligned parallel with the right side frame member. In a ganged setup, the left coupling hook of one chair is insertable into the right slot of the second chair of a like chair. The ganged chairs, when disassembled, can be stacked vertically for ease of transfer. The chairs provide rigid connections and compact configurations when ganged or stacked.

20 Claims, 11 Drawing Sheets

STACKABLE SIDE-BY-SIDE GANGING CHAIR

This application is a continuation-in-part of earlier filed copending U.S. Design Application, Ser. No. 29/090819, filed Jul. 16, 1998.

FIELD OF INVENTION

The present invention relates generally to the field of movable seating, and more particularly to chairs that are stackable during storage, and are connectable side-to-side during use.

BACKGROUND OF INVENTION

In the field of movable seating, chair structures may be designed to be attached side-to-side during use, and may be stackable for storage. It is a preference in the field that the chair structures be easily connectable and disconnectable in side-by-side relationship (i.e. ganged), and the chair structures be stackable when disconnected for ease of movement from one location to another for use, and for storage.

Typical of the art are those devices disclosed in the following U.S. Patents. In U.S. Pat. No. 3,827,749, to Johnson et al., a chair structure is disclosed that may be stacked vertically, and may be connectable side-by-side, with a right-side leg member of a first chair resting below and in contact with a left-side leg member of a second chair. The same side leg of each chair includes a keeper member mounted on an exterior side of the upper portion of each left leg in the form of a vertical flange that engages the leg member of the adjacent chair to gang horizontal with a plurality of like chair structures. The ganging components of adjacent like chair structures are bulky leg members having rectangular cross-sections.

In U.S. Pat. No. Des. 279,438, to Gerner, an ornamental design is disclosed for a tubular chair having inverted U-shaped leg members and seat and back side frame members connected to the tubular chair frame. The design patent does not disclose whether the tubular chair is stackable or connectable in a gang horizontal orientation with like chair structures.

Accordingly, there is a need for an improved chair structure that, when stacked vertically, forms a sturdy and easily movable stack of chairs, and when unstacked and connected to similar chair structures, forms a space-efficient assembly of chairs in ganged horizontal orientation which are easily connectable and disconnectable.

Therefore, it is an object of the present invention to provide a chair that is stackable in a generally vertical direction upon other chairs with similar structure.

It is a further object of the present invention to provide a chair structure that is easily connectable side-by-side in a horizontal direction with other chairs with similar structure.

It is an additional object of the present invention to provide a ganged chair structure having a leg structure that facilitates stacking and efficient side-by-side connection of chairs in ganged configuration.

SUMMARY OF INVENTION

In accordance with the present invention, an improved chair structure is disclosed that provides a vertically stackable, and horizontally ganging chair for supporting a user seated in the chair, including an upper frame adapted to receive and support a generally planar seat and a backrest. As desired, the upper frame may include a detachable resilient seat cushion and a detachable resilient backrest. The chair further includes a lower frame comprising first and second leg members depending from a first side of the lower frame, and third and fourth leg members depending from a second side of the lower frame, each of the leg members having an upper end and a lower end adapted to engage the supporting surface for the chair.

The first and second leg members include a first connector member extending between and fixedly interconnecting the upper ends of the first and second leg members one to another. The third and fourth leg members include a second connector member extending between and fixedly interconnecting the upper ends of third and fourth leg members one to another. A front cross-member connects the front first leg member and the front third leg member at an upper portion of each front leg member, the front cross-member being recessed under the front of the upper frame. A rear cross-member connects a rear second leg member and a rear fourth leg member at an upper portion of each rear leg member.

The first and second connector members are disposed inwardly of the lower frame whereby the upper ends of each of the leg members which are connected to a respective connector member are disposed outwardly of the respective connector member. In accordance with one aspect of the present invention, the first connector member includes an outer first side with a first side coupling support extending outwards from the first side. The first side coupling support includes a first side extension disposed outwardly from the first side coupling support, with a coupling hook projecting outwardly from the first side extension. The second connector member includes an outer second side with a second side coupling support extending outwards from the second side. The second side coupling support includes a second side extension disposed outwardly from the second side coupling support, with a lower surface in the second side extension having an opening slot therein, the slot aligned parallel with the second connector member. The first side extension coupling hook of a first chair is insertable into the slot within the lower surface in the second side extension of a further like chair in a side-by-side relationship.

When the first chair upper frame is attached side-by-side with further like ganged chairs of similar design, the first and second leg members of the first chair fit next to, or side-by-side to the third and fourth leg members of the second chair, and provide a compact side-by-side configuration with interlocking coupling hooks inserted into adjacent slots of the further like chair. The interlocking hooks and slots allow attachment of a plurality of like chairs, providing for exact spacing and positioning of ganged chairs in a horizontal alignment. The combination of elements of the improved ganged chair structure provides a chair structure that is easily and quickly connectable and disconnectable with the connecting hooks and slots hidden from a user of each chair, occupies a compact floor space when connected side-by-side with similar chairs, and provides efficient use of seating capacity within meeting facilities of limited space.

BRIEF DESCRIPTION OF DRAWINGS

The above mentioned objects and advantages of the present invention are readily apparent from the description contained herein, and by reference to the claims, read together with the drawings in which:

DETAILED DESCRIPTION OF INVENTION

Figure 1:
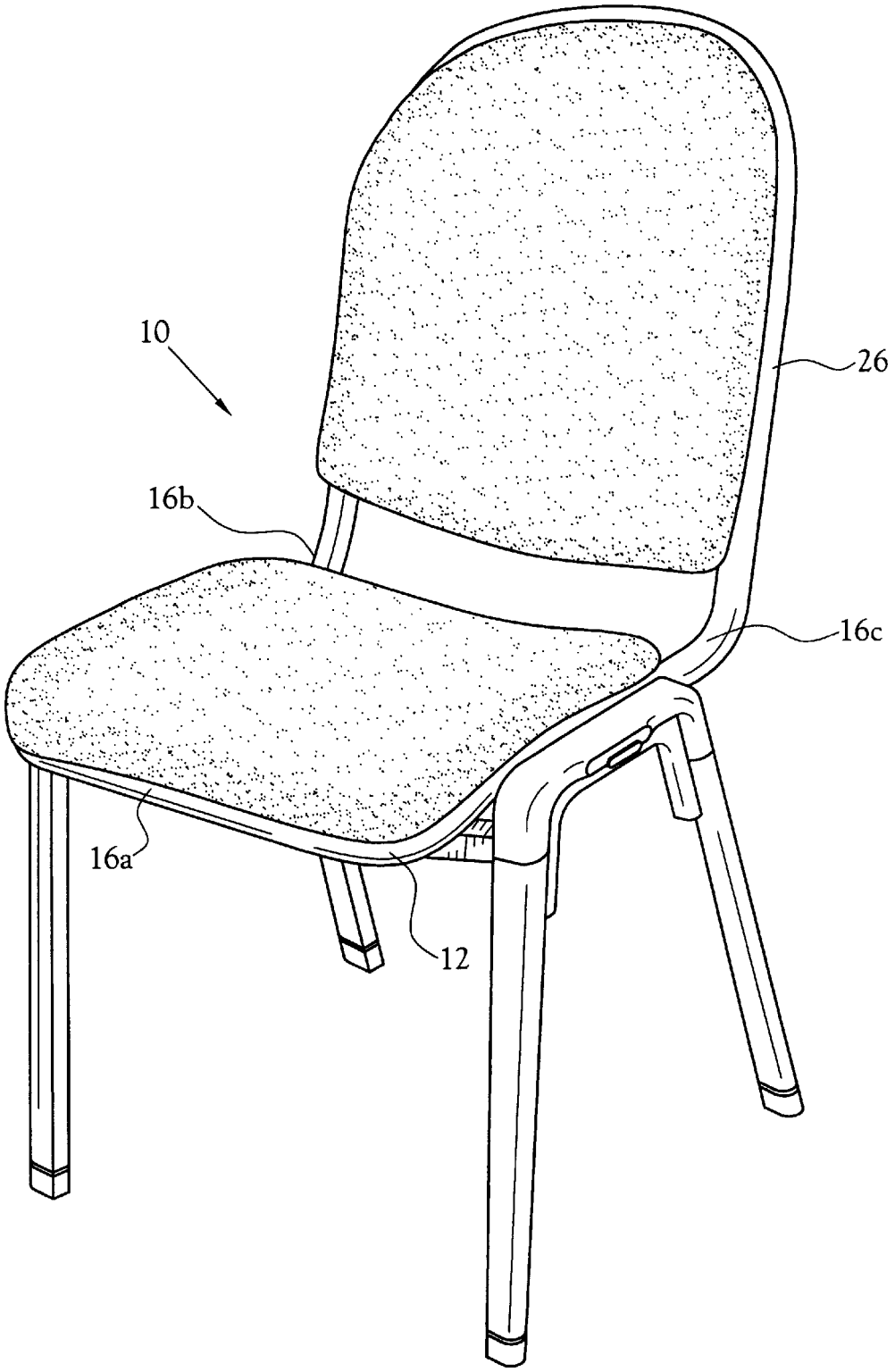
FIG. 1 is a perspective view of one embodiment of a stackable side-by-side ganged chair of the present invention.
Figure 2:
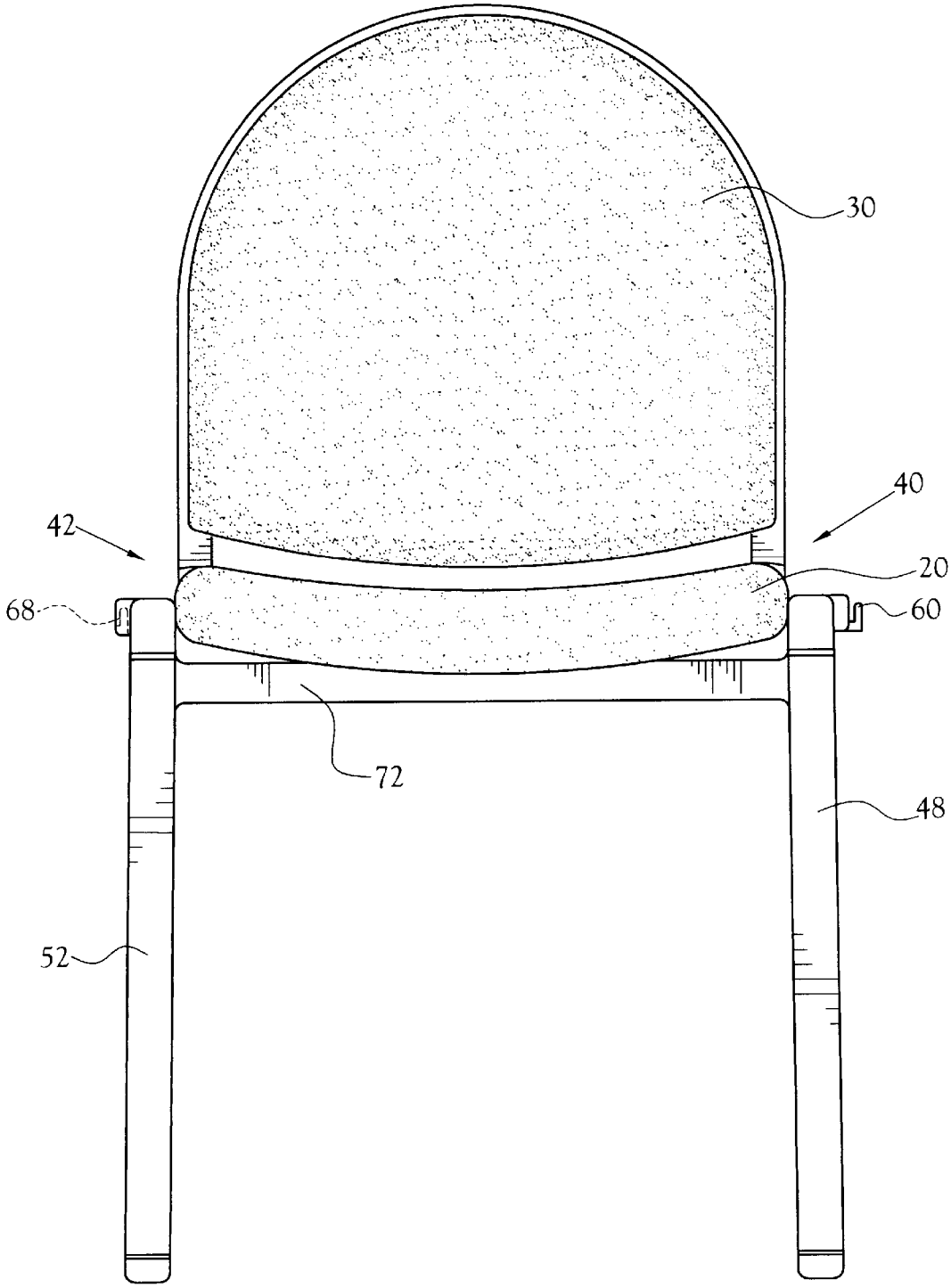
FIG. 2 is a front view of the ganged chair of FIG. 1, illustrating a left side couple on the left side chair leg cover.
Figure 3A:
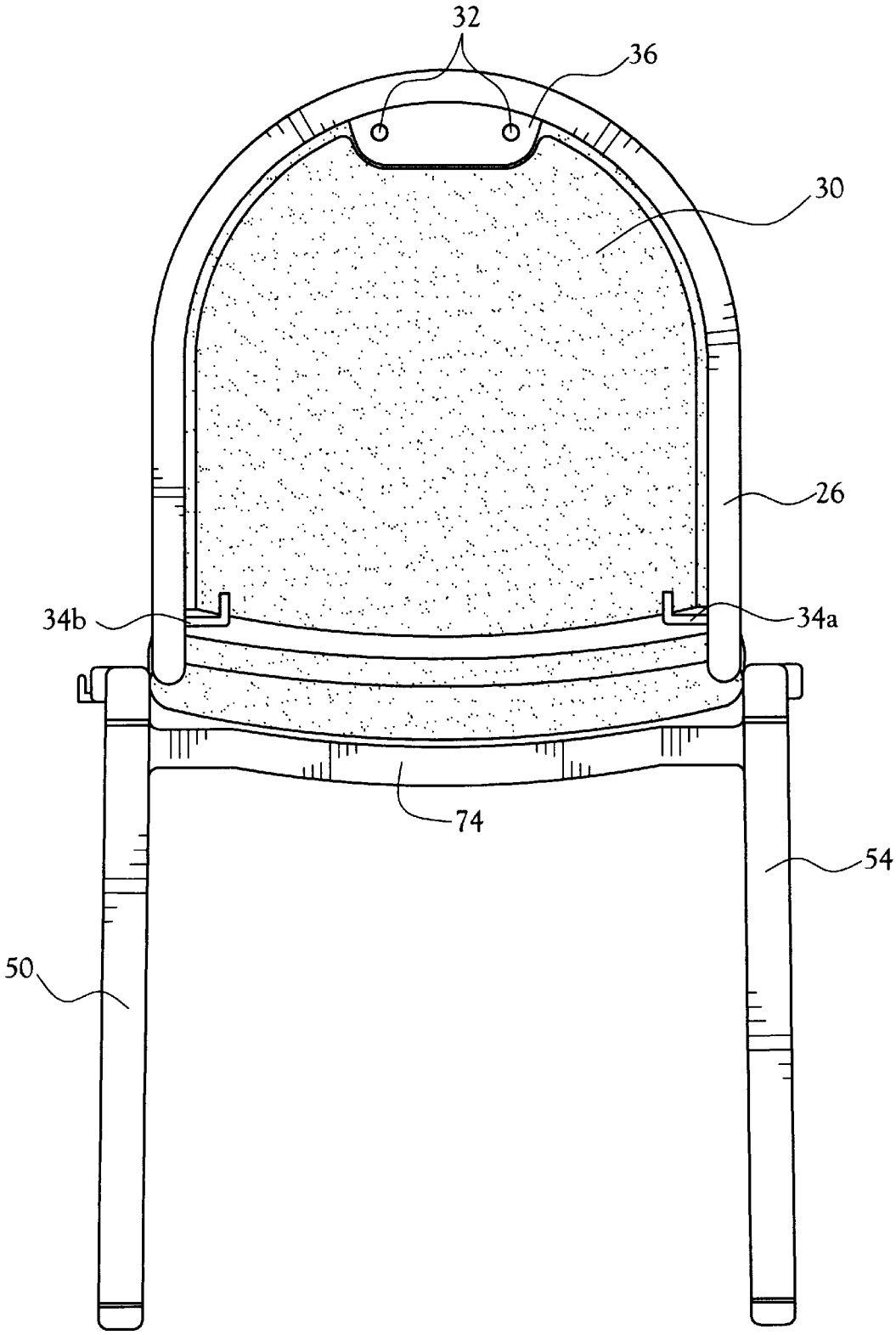
FIG. 3*a* is a rear view of the ganged chair of FIG. 1 illustrating the connectors for the back cushion.
Figure 3B:
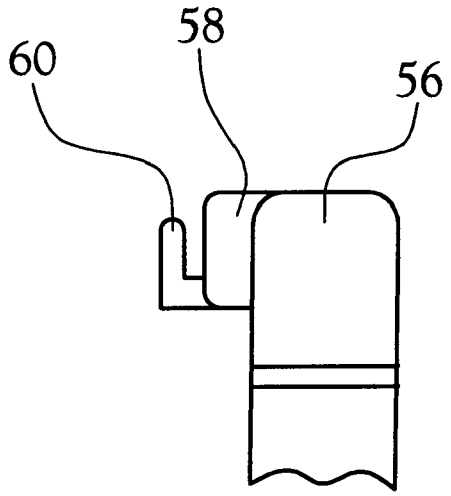
FIG. 3*b* is an exploded view of the left side of the ganged chair of FIG. 3*a* illustrating the coupling hook.
Figure 3C:
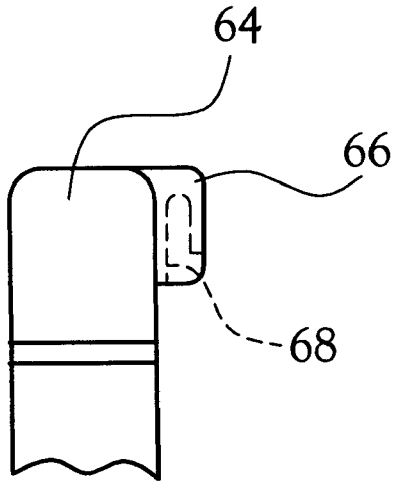
FIG. 3*c* is an exploded view of the right side of the ganged chair of FIG. 3*a* illustrating the interior slot.
Figure 4:
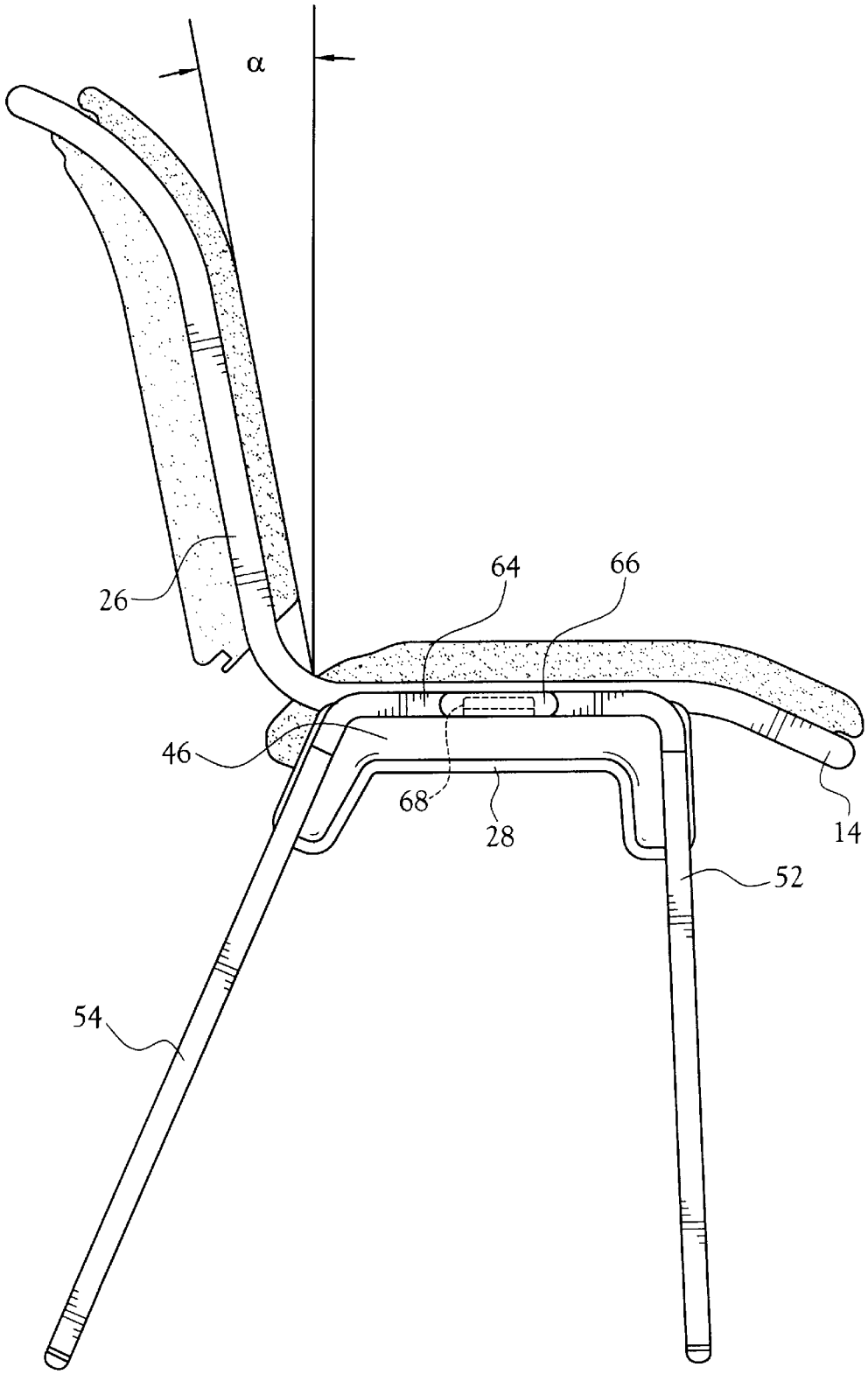
FIG. 4 is a right side view of the ganged chair of FIG. 1 illustrating the mid-area position of the right side interior slot.

A stackable ganged chair incorporating various features of the present invention is illustrated generally at 10 in FIGS. 1–10. The stackable chair 10, is designed for vertical stacking (see FIG. 10), and for horizontal side-by-side connecting (see FIG. 10).

From the foregoing description, it will be recognized by those skilled in the art that a stackable ganged chair 10 offers advantages by providing a plurality of chairs 10 of like design that are attachable side-by-side by a covered coupling hook and slot, in less time, with less floor space width for a given number of ganged chairs, and with increased seating capacity for each assembled horizontal row of ganged chairs 10.

Specifically, the present invention includes an upper frame 12 (see FIG. 1), suitably formed of generally cylindrical tubes 14 (see FIGS. 1 and 7*b*) that define a generally rectangular upper frame base portion 16 (see FIG. 7*a*), having at least three sides comprising a front side tube 16*a*, a right base, or second side 16*b*, and a left base, or first side 16*c*. The rear portion of the right base side 16*b* and the rear portion of the left base side 16*c* curve upwards to form the backrest platform 26 (see FIG. 3*a*) of the upper frame 12.

Figure 7A:
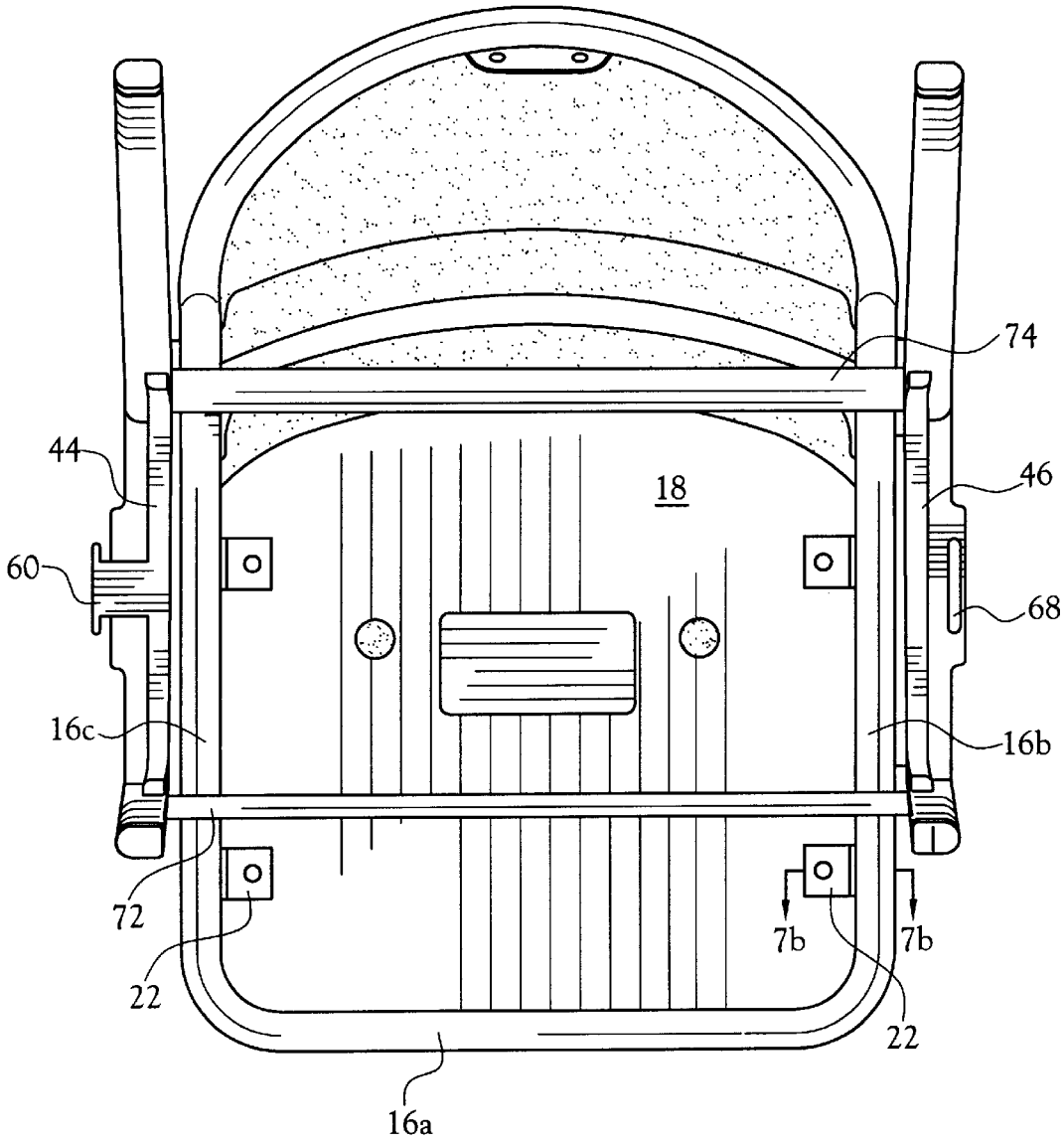
FIG 7*a* is an underneath view of one embodiment of the front cross-member and rear cross-member of a ganged chair in accordance with the present invention, illustrating the opening within the interior slot of the right side coupling support, and an upper bracket of the backrest of the ganged chair.
Figure 7B:
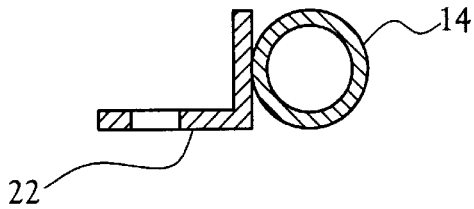
FIG. 7*b* is a cross-section taken generally along line 7*b*—7*b*' of FIG. 7*a*, illustrating the shape of the chair frame and the connector bracket underneath the seat platform.
Figure 8:
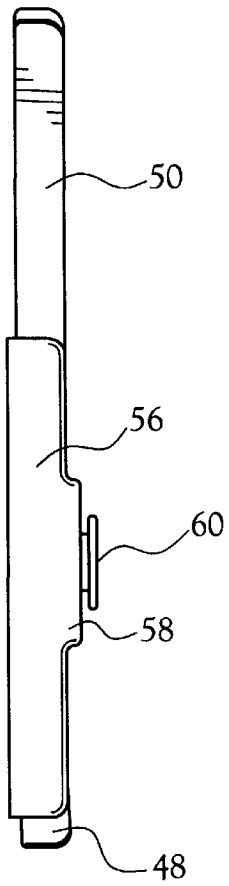
FIG. 8 is a detailed side view of the placement of the left coupling hook of one chair into the right interior slot of an adjacent chair of side-by-side ganged chairs.
Figure 8:
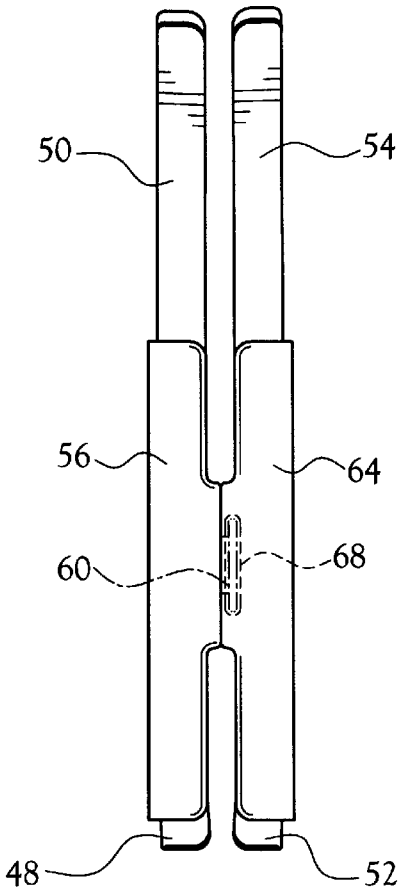

The at least three sides 16*a, b, c*, form the frame base portion for supporting a seating platform 18 thereon (see FIG. 7*a*), which may support a resilient seat cushion 20 that is connectable onto the seating platform 18 by attaching approximately four screw connectors (not shown) to approximately two pair of connector brackets 22, 22' that are bonded to the underside of the right base side 16*b*, and the left base side 16*c* (see FIGS. 7*a* and 7*b*). The screw connectors when removed, allow for the seat cushion 20 to be changed quickly for another cushion of similar or different materials or patterns, allowing use of the ganged chair 10 in a multitude of casual, business, or formal settings.

Figure 6:
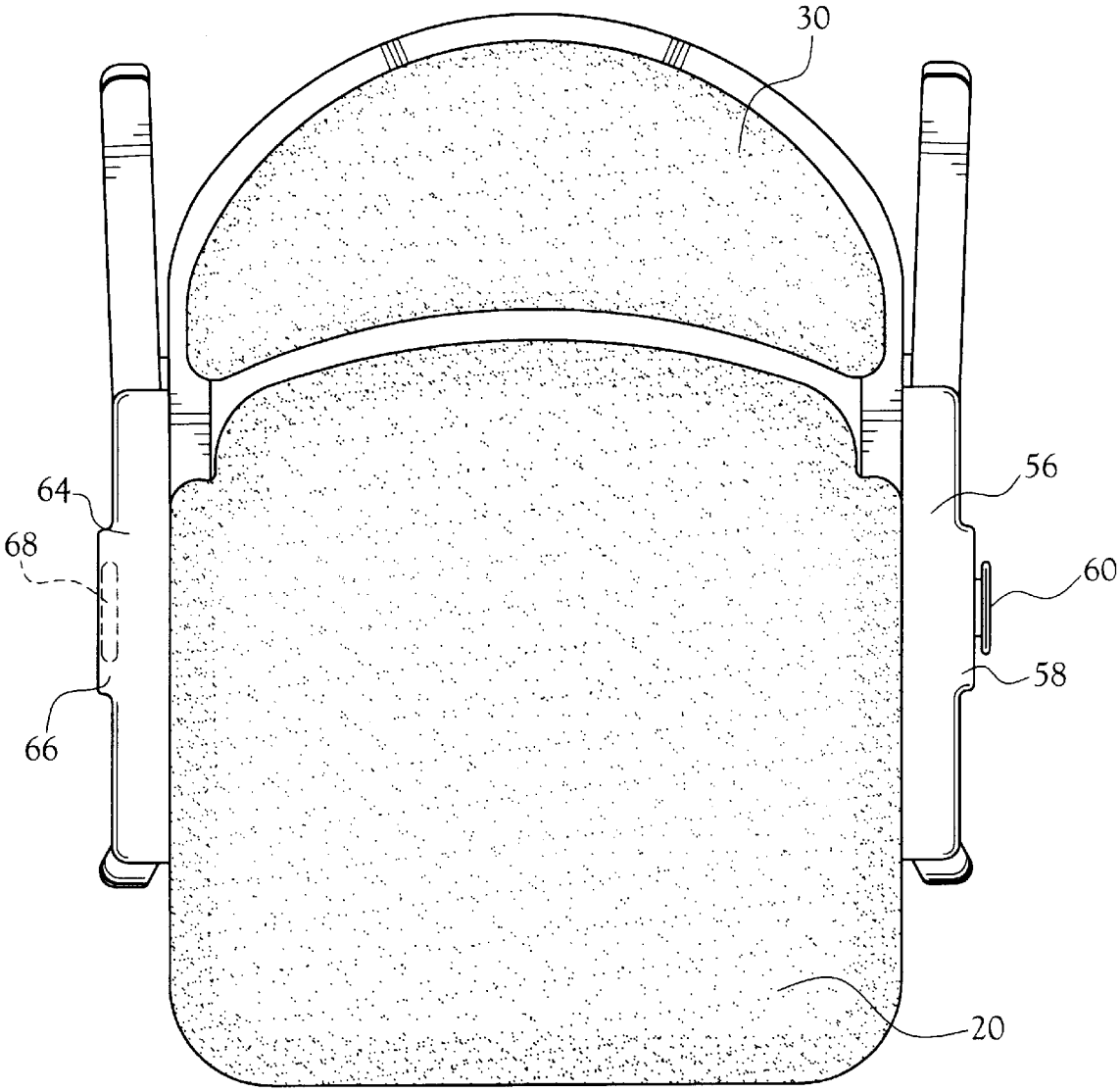
FIG. 6 is a top view of the ganged chair of FIG. 1 illustrating the positions of the right side interior slot and the left side coupling hook.

The backrest platform 26 of the upper frame 12 curves upward from the rearward end of right base side 16*b*, and a left base side 16*c*, forming a backrest platform 26 which may include a resilient back cushion 30 (see FIG. 6). The upper section of the back portion 26 is angled backward, forming a slight angle ( ) from the vertical (see FIG. 4), allowing for a natural back rest for the normal posture of a sitting person. The back cushion 30 is detachable to the front surfaces of the backrest platform 26 by placing the back cushion 30 downward and on two prong supports 34*a, b*, that are connected to the right and left side sections of the back portion 26 (see FIG. 3*a*). Once the cushion 30 is placed on the prong supports 34*a, b*, the upper portion of the back cushion 30 is detachable by screw connectors into screw holes 32 to the upper bracket 36 that is connected to the backrest platform 26. The back cushion 30 can be changed quickly with another back cushion of similar or different materials or patterns, with the cushion 30 encircled by backrest 26 (see FIG. 2),allowing use of the ganged chair 10 in a multitude of casual, business, or formal settings.

The chair frame 12 of the present invention further comprises a lower frame including a first side, or left side connector member 44 (see FIG. 5), and a second side, or right side connector member 46 (see FIG. 4), that are parallel to each other. The left side connector member 44 is parallel to and located outwards of the left base side 16*c* of the left side 40, and the right side connector 46 is parallel to and located outwards of the right base side 16*b* of the right side 42 (see FIGS. 2 and 7*a*).

Figure 5:
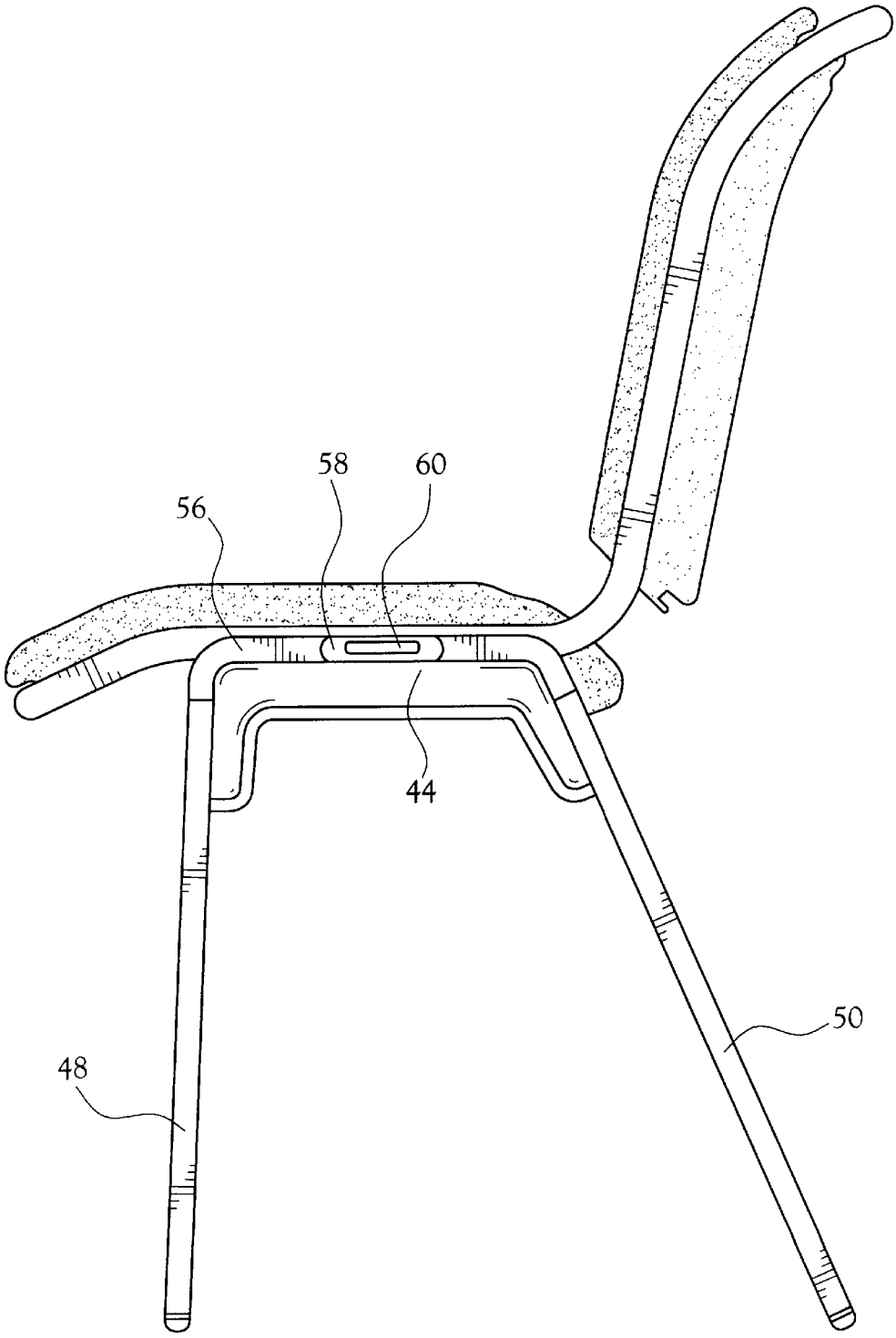
FIG. 5 is a left side view of the ganged chair of FIG. 1 illustrating the mid-area position the left side coupling hook.

The left side frame member 44 includes a left side, or first side coupling support 56 that fits over the left side frame member 44 (see FIG. 6), and connects between an upper portion of the left front leg 48 and the rear left leg 50 (see FIG. 5). The right side frame member 46 connects between an upper portion of the front right leg 52 and the rear right leg 54 and includes a right side, or second side coupling support 64 that fits over the right side frame member 46 (see FIGS. 4 and 6). Each side frame member can include a plastic or rubber edge cover 28 on the lower surface of each frame member (see FIG. 4) for protection of the lower surface during vertical stacking of the chair frames one on another.

Figure 10:
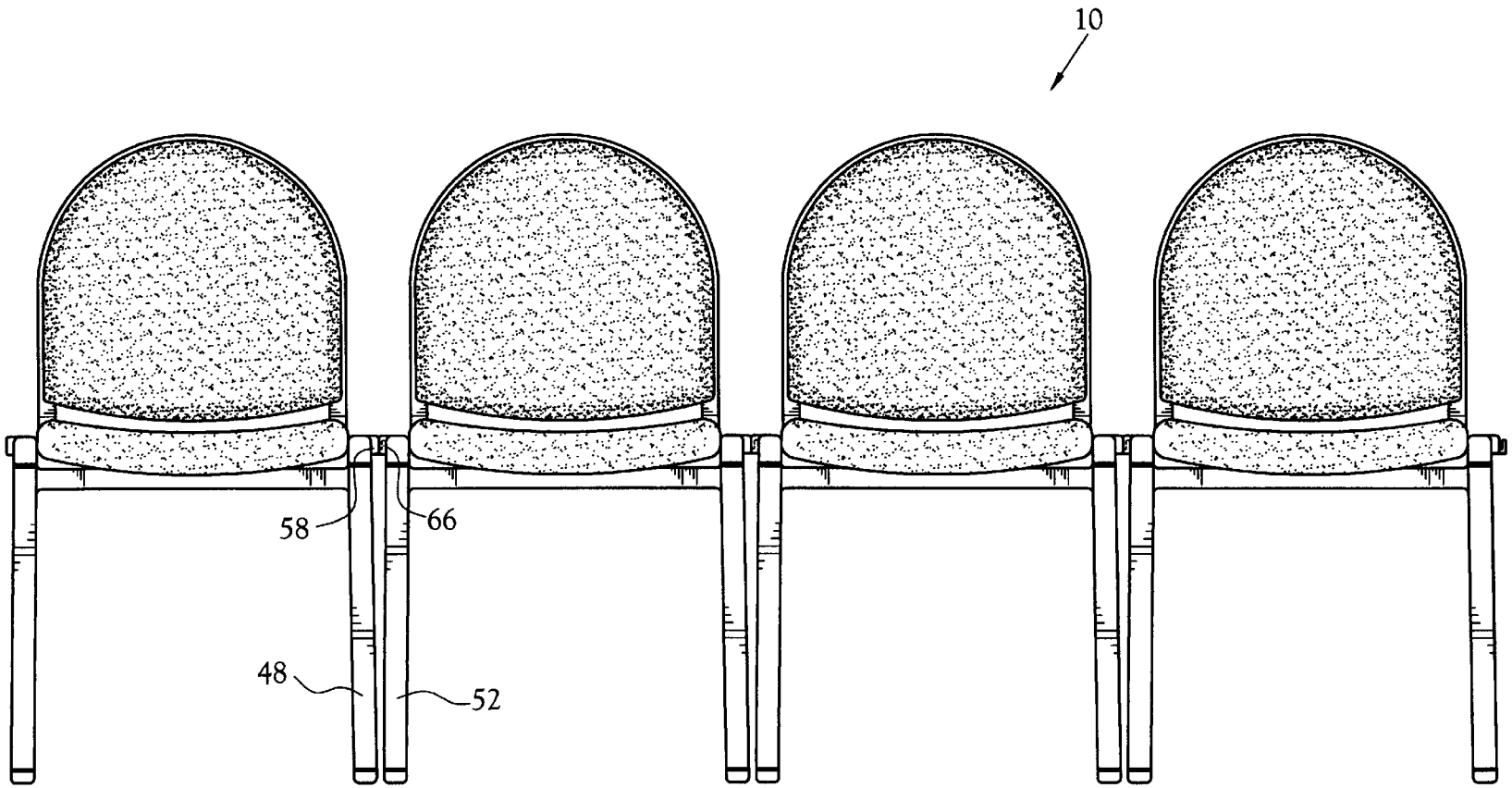
FIG. 10 is a front view of a plurality of ganged chairs of the present invention oriented side-by-side as an interconnected group of chairs.

A locking mechanism is incorporated in the lower frame to allow side-by-side and rigid positioning of a plurality of upper frames 12 (see FIG. 10). A left coupling hook 60 extends laterally outward from a left extension 58 of the left side coupling support 56 (see FIGS. 5, 6, and 8). The coupling hook 60 is insertable into a groove or slot 68 opening in the underside surface of a right extension 66 of the right side coupling support 64 (see FIGS. 4, 6, and 8). The interlocking of the left side coupling hook 60 into the slot 68 of the right extension 66 of the right side coupling support 64 of an adjacent upper frame 12 (see FIGS. 8 and 10), provides structural integrity of the ganged chairs 10 when positioned side-by-side. The left coupling 60 insertion into the slot 68, provides a flush fit of the left extension 58 against the right extension 66, which allows an upper snag-free surface of left coupling support 56 and right coupling support 64, and a pinch-free surface exposed to the seat occupants in case the ganged chairs are moved in unison (see FIG. 10).

Each respective chair leg can be circular, oval, rectangular, or other cross-sectional shape, with a forward facing and rearward facing surface on each leg. In the depicted embodiment, the front pair of chair legs 48, 52 are inclined at a selected angle forward relative to a vertical line extending downward from the front cross-member 72. The rear pair of chair legs 50, 54 are inclined at a selected angle backward relative to a vertical line extending downward from rear cross-member 74. The angle backward of rear pair of legs 50, 54 is a greater angle than the angle forward of the front pair of chair legs 48, 52. The rear pair of legs 50, 54 can be longer by approximately one to two inches than the front pair of legs 48, 52 to allow for a generally horizontal position of the seat platform 18 and seat cushion 20. The angle forward of the front pair of legs, and the angle backward of the rear pair of legs allows for ease of stacking of a plurality of chair frames on top of each other in a vertical orientation (see FIG. 9).

Structural rigidity of the upper frame 12 and front pair of legs 48, 52, and rear pair of legs 50, 54, may be increased by a front cross-member 72 that connects to and extends between a front inner surface of the left side frame member 44, to a front inner surface of the right side frame member 46, each side frame member being attached respectively between the left side legs and right side legs. A rear cross-member 74 is connected to and extends between a rear inner surface of the left side frame member 44, to a rear inner surface of the right side frame member 46. The left side frame member 44 is of approximately the same length as the right side frame member 46, so that the front cross-member 72 is approximately parallel to the rear cross-member 74 as each cross-member traverses underneath the seat platform 18 from the front inner surface of the right side frame member 46, to the front inner surface of the left side frame member 44. An alternative description is that the front cross-member 72 and rear cross-member 74 are parallel to each other, and are parallel respectively to the front 16*a* upper frame. The width between the front cross-member 72 and rear cross-member 74 is approximately the same as the cross-members extend from the right side frame member 46 to the left side frame member 44.

The orientation of the front cross-member 72 and rear cross-member 74, and the inclined angles of the front pair of chair legs (frontward), and the rear pair of chair legs (rearward), allow the right side legs 52, 54 and right side coupling support 64 of one upper frame 12 to be connected with minimal separation between the left side coupling support 56 and left side legs 48, 50 of another chair frame of similar design, in a ganged configuration (FIG. 10). An alternative description is when the upper frame 12 is oriented side-by-side with other frames of similar design in a ganged or horizontally oriented seating arrangement, the left side legs 48, 50 of a first upper frame 12 are positionable parallel to and beside the right side legs 52, 54 of a second chair frame. This positioning provides advantages over the prior configurations of side-by-side seating. The side-by-side positioning of a plurality of upper frames 12 in an integral ganged set of chairs enables grouping of a larger number of chairs in a row across a set width of floor space, providing increased seating capacity for a limited width of seating (FIG. 10). Also, the orientation of the left legs of each chair positioned substantially parallel to and beside the right legs of adjacent chairs provides a near fool-proof setup of chairs in a time-efficient manner.

Figure 9:
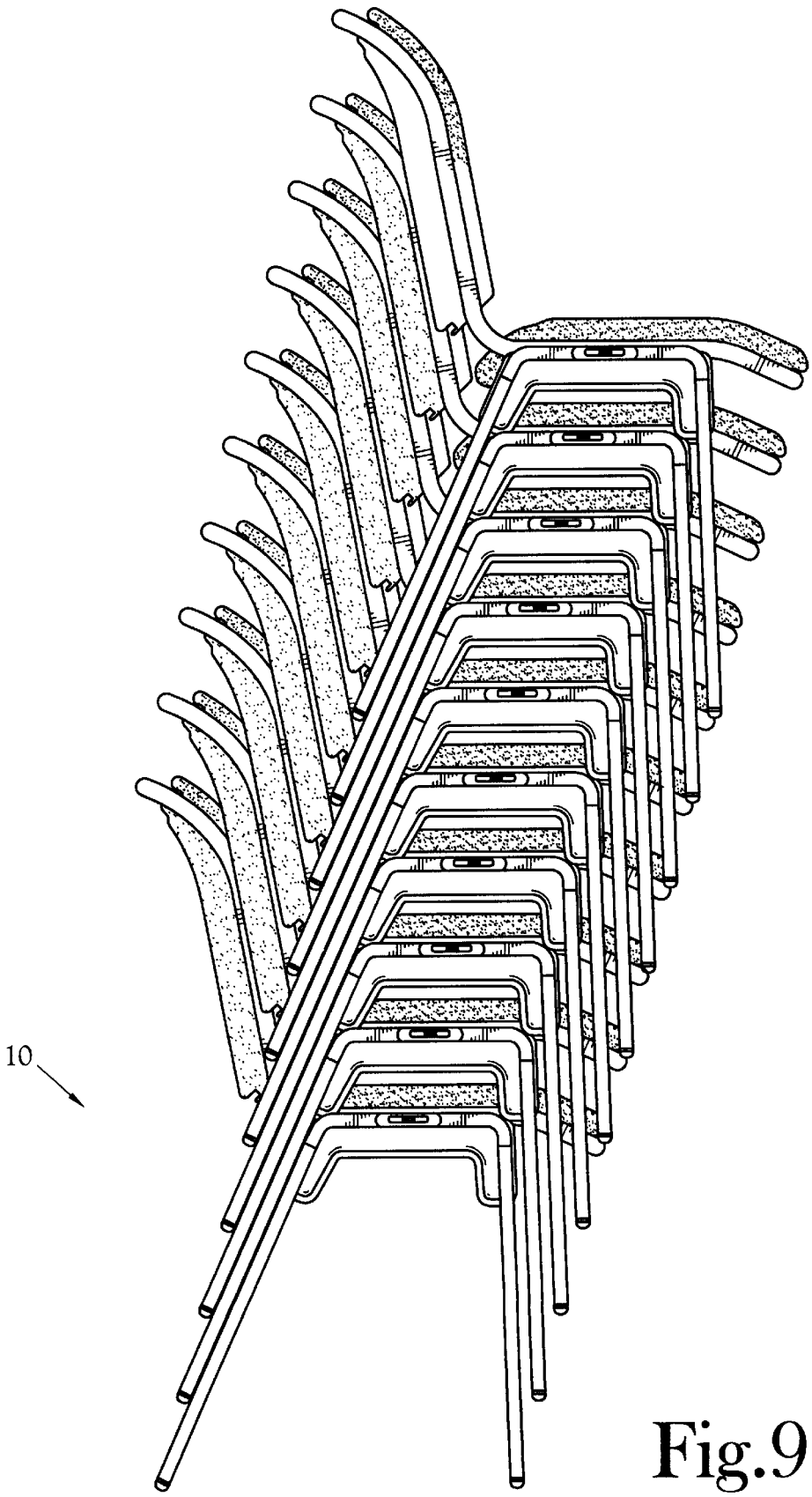
FIG. 9 is a right side view of a plurality of ganged chairs of the present invention stacked vertical.

The positioning of the left side frame member 44 and the right side frame member 46 on the respective outer surfaces of the left side 16*c* and right side 16*b* of the upper frame 16, and the selected angle frontward of the front legs, and angle rearward for the back legs, provides ease of stacking of a plurality of chairs in an approximately vertical stack of upper frames 12 (see FIG. 9). In addition, the positioning of the left side coupling support 56, and the right side coupling support 64, flush with, or lower than the upper surface of the resilient seat cushion 20 connectable to the upper frame 16, minimizes the potential of contact between a seated person's clothing or elbows with the upper surfaces of each of the legs 48, 50, 52, 54.

The above described upper frame 12 may include tubular upper frame members, and can provide similar beneficial uses of vertical stacking and side-by side ganged positioning of chairs in compact configurations if the upper frame 16 of the upper frame 12 is constructed in a reverse configuration with a right side frame member 46 having a right couple or hook (not shown), and having a left side frame member 44 having a left interior slot (not shown). Connection of the ganged side-by-side chairs would be connectable as explained above, hook fitting up into the slot on an adjacent chair of similar configuration.

An alternative interlocking system includes multiple hooks on a left side of each chair, or a plurality of male connectors, and multiple slots, or channels on a right outer-side of adjacent chair legs, for side-by-side connection of ganged chairs. Each of the male connectors would fit into a respective slot, providing the interlocking of the left side coupling into the respective slot of the right extension of the right side coupling support of an adjacent chair frame (see FIG. 10), and providing structural integrity of the ganged chairs 10 when positioned side-by-side. The multiple left couplings inserted into the multiple slots, provide a flush fit of the left extension against the right extension, which allows an upper snag-free surface of left coupling support and right coupling support, and a pinch-free surface exposed to the seat occupants in case the ganged chairs are moved in unison (see FIG. 10).

While a preferred embodiment is shown and described, it will be understood that it is not intended to limit the disclosure, but rather it is intended to cover all modifications and alternate methods falling within the spirit and the scope of the invention as defined in the appended claims. One skilled in the art will recognize variations and associated alternative embodiments. The foregoing description is exemplary in nature and the spirit and scope of the appended claims should not be limited to the description of the embodiment of the invention contained herein.

What is claimed is:

1. A stackable chair that is capable of being ganged with a chair in side-by-side relationship comprising:

an upper frame adapted to receive and support a seating platform thereon, said upper frame having a front side, a first side and a second side, each of said first and second sides having rear ends attached to a backrest platform for supporting a user seated in the chair, a lower frame having first and second sides supporting said upper frame above a supporting surface for the chair, said lower frame including a front side, and first and second leg members disposed on said first side of said lower frame, and third and fourth leg members disposed on said second side of said lower frame, each of said leg members having a lower end adapted to engage the supporting surface for the chair, and an upper end, a first connector member extending between and fixedly interconnecting said upper ends of said first and second leg members to one another, said first connector having an outer first side, a second connector member extending between and fixedly interconnecting said upper ends of said third and fourth leg members to one another, said second connector having an outer second side, said first and second connector members generally occupying a common generally horizontal plane which effectively defines the upper limit of said first and second sides of said lower frame, and a first side and a second side coupling support located respectively on outer first and second sides of said first and second connector members, said first side and said second side coupling support occupying said common plane, said first side coupling support having a first side extension disposed outwardly from said first side coupling support, said first side extension having a coupling hook projecting outwardly from said first side extension, said coupling hook occupying said common plane, said second side coupling support having a second side extension disposed outwardly from said second side coupling support, said second side extension having a lower surface with an opening slot therein, said slot aligned parallel with said second connector member, whereby said first side extension coupling hook of said first side of the ganged chair is insertable into a slot within a lower surface of a second side extension of a second side of another chair in side-by-side relationship, and whereby said upper frame and said lower frame of said chair are maximally stackable with one or more other chairs.

2. The stackable chair of claim 1, wherein the lower ends of all of the leg members of the ganged chairs are in direct supporting engagement with a supporting surface for the chairs.

3. The stackable chair of claim 2, wherein said leg members further comprise:

said first and third leg members are disposed forward respectively of said second and fourth leg members, said first and third leg members are inclined at a first angle forward relative to a vertical line extending downward from said front side of said upper frame; and said second and fourth leg members are inclined at a second angle backward relative to a vertical line extending downward from said rear ends of said first and second sides of said upper frame.

4. The stackable chair of claim 3, wherein said angle forward of said first leg member is substantially equal to but not greater than said angle forward of said third leg member, and said angle backward of said second leg member is substantially equal to but not greater than said angle backward of said fourth leg member.

5. The stackable chair of claim 4, wherein said upper frame further comprises a substantially horizontal portion supporting said seating platform, said upper frame includes a back frame portion extending upwardly and rearwardly from said seating platform, said back frame portion having a detachable backrest, an upper bracket, a lower pin connector, and a means of releasably mounting said upper bracket of said back frame to said backrest.

6. The stackable chair of claim 5, wherein said means of releasably mounting comprises at least one connector releasably attachable through said upper bracket and into said detachable backrest.

7. The stackable ganged chair of claim 6, wherein said backrest further comprises an upper area and a lower area of said detachable backrest, said upper bracket of said back frame portion aligned with said upper area of said backrest, said lower area of said backrest having a lower surface with a plurality of holes therein, said lower pin connector of said back frame portion having two inwardly positioned pins that extend upward from said back frame portion, said pins insert into said lower surface holes of said detachable backrest.

8. A stackable ganged chair that is capable of side-by-side orientation with one or more additional chairs in side-by-side relationship comprising:

a chair frame having an upper frame, and a lower frame, said upper frame adapted to receive and support a seating platform thereon, said upper frame having a front side, a first side and a second side, each of said first and second sides having rear ends attached to a backrest platform for supporting a user seated in the ganged chair, said lower frame having first and second sides supporting said upper frame above a supporting surface for the chair, said lower frame including left front and left rear leg members disposed on said first side of said lower frame, and right front and right rear leg members disposed on said second side of said lower frame, each of said leg members having a lower end adapted to engage the supporting surface for the chair, and each of said leg members having an upper end, said lower frame further including:

a front cross-member connected between said upper ends of said left front leg member and said right front leg member, said front cross-member positioned proximally underneath said upper frame, a rear cross-member connected between said upper ends of said left rear leg member and said right rear leg member, said rear cross-member positioned proximally underneath said upper frame, a left side connector member extending between and fixedly interconnecting said upper ends of said left front and left rear leg members to one another, a right side connector member extending between and fixedly interconnecting said upper ends of said right front and right rear leg members to one another, said left side and right side connector members generally occupying a common plane, a left side coupling support positioned above and onto said left side connector member, said left side coupling support having a left extension with a coupling hook extending laterally from said left extension, said coupling hook occupying said common plane, and a right side coupling support positioned above and onto said right side connector member, said right side coupling support having a right extension with an interior, downward opening, slot aligned parallel with said right side frame member, whereby said left side coupling hook of the ganged chair is insertable into a slot of said right extension of a second ganged chair of similar dimensions, whereby said chair frame is stackable on top of another stackable ganged chair.

9. The stackable ganged chair of claim 8, wherein said leg members further comprise said left front and right front leg members are inclined at a forward angle relative to a vertical line extending downward from said front side, and said left rear and right rear leg members are inclined at a rearward angle relative to a vertical line extending downward from the rear ends of said first and second sides of said upper frame.

10. The stackable ganged chair of claim 9, wherein said forward angle of said left front leg member is substantially equal to but not greater than said forward angle of said right front leg member, and said rearward angle of said left rear leg member is substantially equal to but not greater than said rearward angle of said right rear leg member.

11. The stackable ganged chair of claim 10, wherein said upper frame further comprises a substantially horizontal portion supporting said seating platform, said upper frame includes a back frame portion extending upwardly and rearwardly from said seating platform, said back frame portion having a detachable backrest, an upper bracket, a lower pin connector, and a means of releasably mounting said upper bracket of said back frame to said backrest.

12. The stackable ganged chair of claim 11, wherein said means of releasably mounting comprises at least one connector releasably attachable through said upper bracket and into said detachable backrest.

13. The stackable ganged chair of claim 12, wherein said backrest further comprises an upper area and a lower area of said detachable backrest, said upper bracket of said back frame portion aligned with said upper area of said backrest, said lower area of said backrest having a lower surface with a plurality of holes therein, said lower pin connector of said back frame portion having two inwardly positioned pins that extend upward from said back frame portion, said pins insert into said lower surface holes of said detachable backrest.

14. The stackable ganged chair of claim 13, wherein said seating platform further comprises a seat pad removably detachable by a plurality of connectors to said seating platform, said seat pad is replaceable by removal of said plurality of connectors.

15. The stackable chair of claim 14, wherein the lower ends of all of the leg members of the ganged chairs are in direct supporting engagement with a supporting surface for the chairs.

16. An improved stackable chair that is capable of being ganged with a chair in side-by-side relationship, comprising a chair platform having an upper frame having a front side, a right side, and a left side, said upper frame including:

a seating platform, said seat platform having a seat pad detachable above said upper frame, and a backrest platform, said backrest platform angled backward from the vertical position;

wherein the improvement comprises:

a lower frame having a left side and a right side supporting said upper frame above a supporting surface for the chair;

a chair leg structure attached to said lower frame, said leg structure including:

a left frame member connected to said left side, said left frame member having left front and left rear legs connected at said upper end of said frame member, each of said left legs having an upper front end and upper rear end, said front left leg connected to said upper front end of said left side frame member; and said rear left leg connected to said upper rear end of said left side frame member;

a right side frame member connected to said right side, said right side frame member having a right side pair of legs connected at the corner ends of said frame member, said pair of legs including:

a front right leg connected to the front corner end of said right side frame member; and a rear right leg connected to the rear corner of said right side frame member;

a front cross-member connected between the front left corner end of said left side frame member, and connected to the front right corner end of said right side frame member, said front cross-member positioned under said seat platform, said front cross-member is parallel with the front frame tube of said chair platform;

a rear cross-member connected to said rear left corner end of said left side frame member, and connected to said rear right corner end of said right side frame member, said rear cross-member positioned under said seat platform, said rear cross-member positioned behind said front cross-member and under said chair platform, said rear cross-member is parallel with said front cross-member; and a left side and a right side coupling support, said left side and said right side coupling supports generally occupying a common generally horizontal plane which effectively defines the upper limits of said first and second sides of said lower frame, said left side coupling support having a left extension with a coupling hook extending laterally from said left extension, said coupling hook occupying said common plane, said right side coupling support having a right extension with an interior, downward opening, slot aligned parallel with said right side frame member;

whereby said left side coupling hook of the ganged chair is insertable into a slot of a right extension of a second ganged chair of similar dimensions;

whereby said chair is stackable on top of another chair structure.

17. The improved stackable ganged chair of claim 16, wherein said backrest platform includes a back pad attachable by a plurality of connectors to said upper portion of said backrest platform, and a lower inside surface of said backrest platform having two inwardly positioned pins that extend upward from said inside surface, said pins insert into a lower end of said back cushion pad, said back pad is attachable to said backrest platform by placement onto said pins and attachment of said screw attachments through said upper portion of said backrest platform and into said back pad, said back pad is replaceable by removal of said about two screw attachments and placement of a similar sized back pad.

18. The improved stackable ganged chair of claim 17, wherein said seat pad is removably detachable by a plurality of connectors to said seating platform, said seat pad is replaceable by removal of said plurality of connectors.

19. A chair having which is stackable and capable of being ganged with one or more additional chairs comprising a frame, including a first set of front and rear leg members defining a first side of said frame, each leg member having a top and a distal end, a first connector member extending between and interconnecting said top ends of said front and rear leg members of said first set of front and rear leg members, said first connector member including a side surface which faces outwardly of the chair, a second set of front and rear leg members defining a second and opposite side of said frame, each leg member having a top and distal end, and a second connector member extending between and interconnecting said top ends of said front and rear leg members of said second set of front and rear leg members, said second connector member including a side surface which faces outwardly of the chair, said first and second elongated connector members generally occupying a common generally horizontal plane which effectively defines the upper limit of said first and second sides of said frame, a connector lug disposed on and projecting outwardly from said outwardly facing surface of said first connector member and including an upstanding flange projecting upwardly from the outboard end of said lug to define a space between said flange and said side surface of said first connector member, said connector lug occupying said common plane, and a receptacle disposed on and projecting outwardly from said outwardly facing surface of said second connector member and defining a downwardly opening slot, said receptacle occupying said common plane, and being suitable for the receipt of an upstanding flange of a connector lug of another chair therein, whereby when a first one of the chairs is disposed with its connector lug adjacent a second one of the chairs and with the receptacle of the second chair in register with the flange of the connector lug of the first chair, the first and second chairs are interconnectable by insertion of the flange of the connector lug of the first chair into the receptacle of the second chair and said interconnection is disposed within said common plane.

20. The stackable chair of claim 19, wherein said frame includes:

an upper frame positioned above and connected interior of said top ends of said front and rear leg members, said upper frame having a substantially horizontal portion supporting a seating platform, said upper frame includes:

a back frame portion extending upwardly and rearwardly from said seating platform, said back frame portion having a detachable backrest, an upper bracket, a lower pin connector, and a means of releasably mounting said upper bracket of said back frame portion to said backrest, a lower area and an upper area of said detachable backrest, said upper bracket of said back frame portion aligned with said upper area of said backrest, a lower surface of said lower area of said backrest, said lower surface having a plurality of holes therein, and an inwardly positioned pin of said lower pin connector of said back frame portion, said inwardly positioned pin is extended upward from said back frame portion, said pin is insertable into said lower surface holes of said detachable backrest.

* * * * *